US006705702B2

(12) United States Patent
Gunther et al.

(10) Patent No.: US 6,705,702 B2
(45) Date of Patent: Mar. 16, 2004

(54) INKJET PRINTING USING PIGMENTED AND DYE-BASED INKS

(75) Inventors: Max S Gunther, La Jolla, CA (US); George M. Sarkisian, San Diego, CA (US); Yinan Xu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 10/016,319

(22) Filed: Oct. 30, 2001

(65) Prior Publication Data

US 2003/0081061 A1 May 1, 2003

(51) Int. Cl.[7] ..... B41J 2/205
(52) U.S. Cl. ..... 347/43; 347/15; 347/100
(58) Field of Search ..... 347/43, 15, 96, 347/100, 16, 37

(56) References Cited

U.S. PATENT DOCUMENTS 4,965,593 A 10/1990 Hickman
5,057,852 A 10/1991 Formica et al.
5,220,342 A 6/1993 Moriyama
5,428,377 A 6/1995 Stoffel et al.
5,568,169 A 10/1996 Dudek et al.
5,596,355 A 1/1997 Koyama et al.
5,742,306 A 4/1998 Gompertz et al.
6,015,206 A 1/2000 Heydinger et al.
6,084,604 A 7/2000 Moriyama et al.
6,178,009 B1 1/2001 Yamada et al.
6,260,941 B1 7/2001 Su et al.
6,336,705 B1 * 1/2002 Torigoe ..... 347/43
6,471,322 B2 * 10/2002 Kanda et al. ..... 347/15

* cited by examiner

*Primary Examiner*—Lamson Nguyen

(57) ABSTRACT

An inkjet printing system and method for printing using both pigmented inks and dye-based inks. A supply of pigmented ink of a certain color is provided, along with another supply of dye-based ink of the same color. A pigmented nozzle array controllably deposits drops of the pigmented ink of the certain color, while a dye-based nozzle array controllably deposits drops of the dye-based ink of the same color. A region of a media is printed with the color by depositing, as governed by a controller, drops from the pigmented supply and drops from the dye-based supply on different subregions of the region.

22 Claims, 8 Drawing Sheets

INKJET PRINTING USING PIGMENTED AND DYE-BASED INKS

CROSS-REFERENCE TO RELATED APPLICATIONS

This application relates to the subject matter disclosed in the co-pending U.S. application Ser. No. 09/675,043, by Yue et al., filed Sep. 28, 2000, titled "Aqueous Ink Jet Inks for Use with Commercial Offset Media and Offset Ink"; and the co-pending U.S. application Ser. No. 09/702,169, by Yue et al., filed Oct. 30, 2000, titled "Aqueous Ink Jet Inks for Use with Commercial Offset Media and Offset Ink". All of these applications are assigned to the assignee of the present invention and are hereby incorporated by reference in their entirety.

BACKGROUND OF THE INVENTION

In recent years, computer printer technology has evolved to a point where very high resolution images can be transferred to various media, including papers of different types. One particular type of printing involves the placement of small drops of a fluid ink onto a surface in response to a digital signal. Typically, the fluid ink is deposited or jetted onto the surface without physical contact between the printing device and the surface. In drop-on-demand inkjet printing, ink droplets are typically propelled from a nozzle by heat or by a pressure wave. Further information as to the basics of inkjet printing technology are further disclosed in various articles in several editions of the Hewlett-Packard Journal [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference.

In general, inkjet inks are either dye-based or pigment-based. Each type of ink offers different advantages when printing high-quality images. Dye-based inks typically use a liquid colorant that is usually water-based. The dye tends to be absorbed into the media surface, and turns the media the color of the dye. Dye-based inks are typically more chromatic and provide more highly saturated colors than pigmented inks. Because of their makeup, however, dye-based inks are usually not water-resistant. They also tend to be more affected by UV light, resulting in the color fading or changing over time.

Pigmented inks typically use a solid colorant to achieve color. With pigmented inks, solid particles remain on the surface of the print media. Once the water in the solution has evaporated, the particles will generally not go back into solution, and are therefore more water-resistant. In many cases, the line quality and accuracy of plots produced by pigment-based inks are superior to that produced by dye-based inks. In addition, pigmented inks are much more UV-resistant than dye-based inks, so that it typically takes a much longer time for noticeable fading of the printed media to occur.

Coated media used for inkjet printing of high-quality images typically have an ink-receptive overcoat, generally of a swellable polymer for absorbing the water-based inks and providing improved receptivity to pigmented inks. However, this special inkjet coated media is significantly more expensive than the coated media generally used in commercial offset printing of high-quality images using oil-based inks. Commercial offset coated media is significantly different from photo/glossy media specifically designed for use with inkjet aqueous-based inks. Typical commercial offset media have a less-porous surface comprised of a coating which requires more time for aqueous fluids to penetrate than standard porous paper. Additionally, offset coatings contain polymers that are more hydrophobic (e.g., styrene-butadiene based) than media coatings specifically designed for inkjet ink (e.g., water-soluble polymers such as polyvinyl alcohol). Thus, most inkjet inks typically produce poor results when used to print on commercial offset papers, showing long dry times, poor spreading characteristics, and poor adherence of pigment to the media coating.

As described in the above-referenced and commonly-owned co-pending U.S. application Ser. Nos. 09/675,043 and 09/702,169, improved pigmented inks have been designed having a binder resin which provides better adherence of the pigment to commercial offset media. Due to the complementary advantages in appearance and durability offered by pigmented inks and dye-based inks, it would be advantageous to be able to print a region of a desired color on commercial offset media using both pigmented inks and dye-based inks. However, dye-based inks typically stain the surface of the media, chemically changing it in such a manner that the binder resin is no longer as effective, thus undesirably degrading the adherence of the pigment to the media in the stained regions.

SUMMARY OF THE INVENTION

In a preferred embodiment, the present invention provides a method of inkjet printing using both pigmented inks and dye-based inks. A supply of pigmented ink of a certain color is provided, along with another supply of dye-based ink of the same color. A region of a media is printed with the color by depositing drops from the pigmented supply and drops from the dye-based supply on different subregions of the region.

The present invention may also be implemented as an inkjet printing system having a pigmented nozzle array and a dye-based nozzle array. The pigmented nozzle array controllably deposits drops of a pigmented ink of a certain color, while the dye-based nozzle array controllably deposits drops of a dye-based ink of the same color. A controller controls the depositing so as to place drops of the pigmented ink and drops of the dye-based ink on adjacent subregions of a region of a media.

BRIEF DESCRIPTION OF THE DRAWINGS

The above-mentioned features of the present invention and the manner of attaining them, and the invention itself, will be best understood by reference to the following detailed description of a preferred embodiment of the invention, taken in conjunction with the accompanying drawings, wherein.

DESCRIPTION OF THE PREFERRED EMBODIMENT

Figure 1:
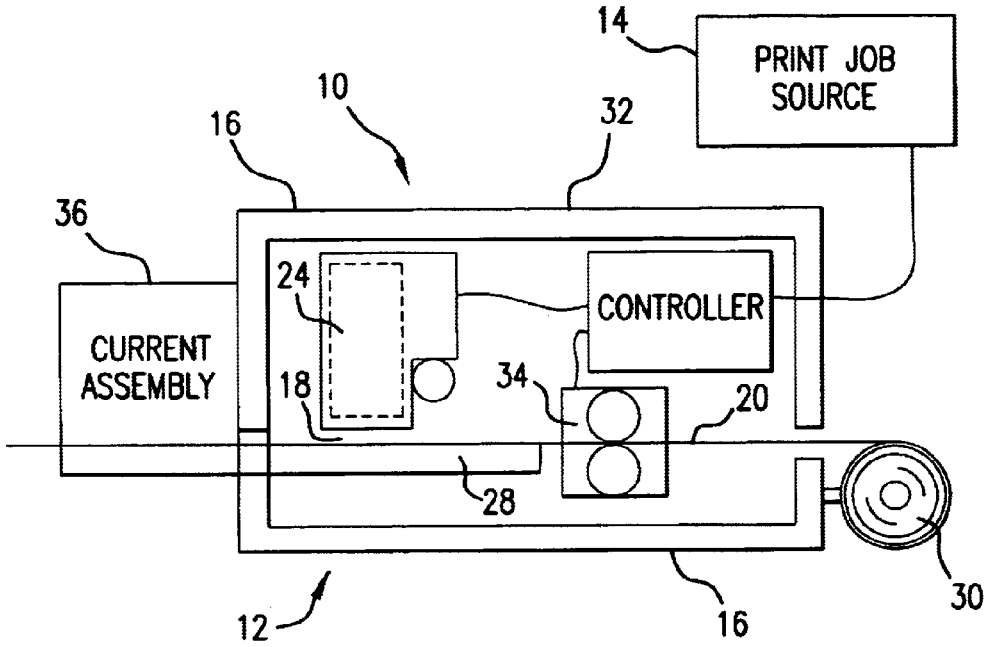
FIG. 1 is a block diagram of an inkjet printing system according to the present invention.
Figure 2A:
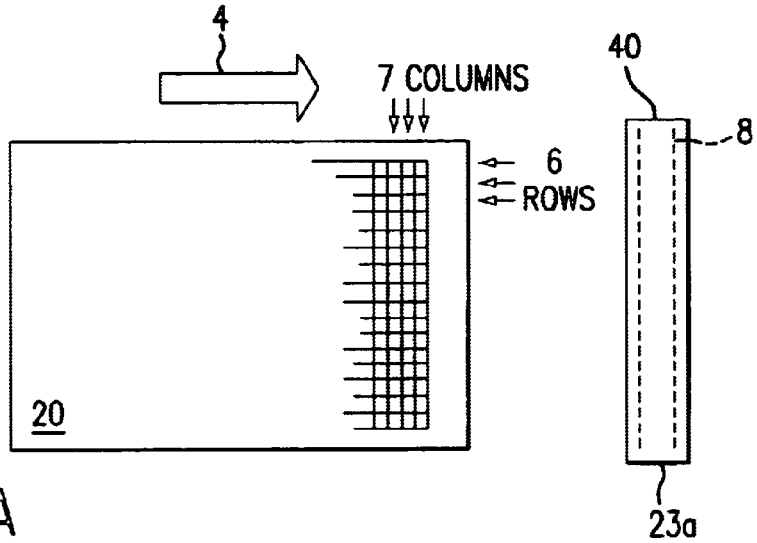
FIGS. 2A–2D are schematic representations of alternative printhead assembly configurations usable for printing on a print medium by the inkjet printing system of FIG. 1.
Figure 2B:
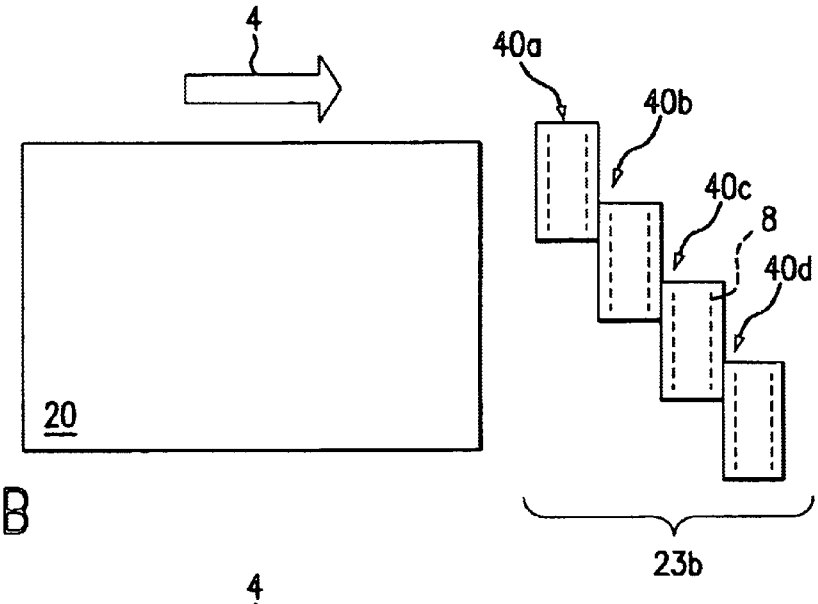
Figure 2C:
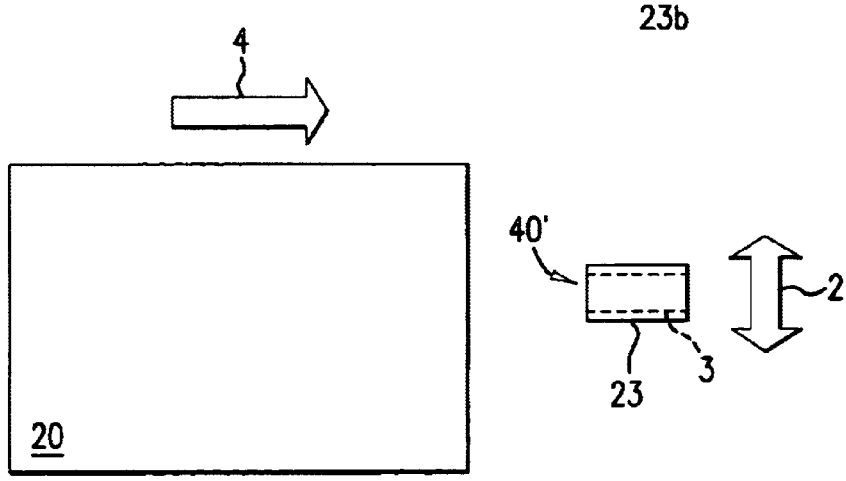
Figure 2D:
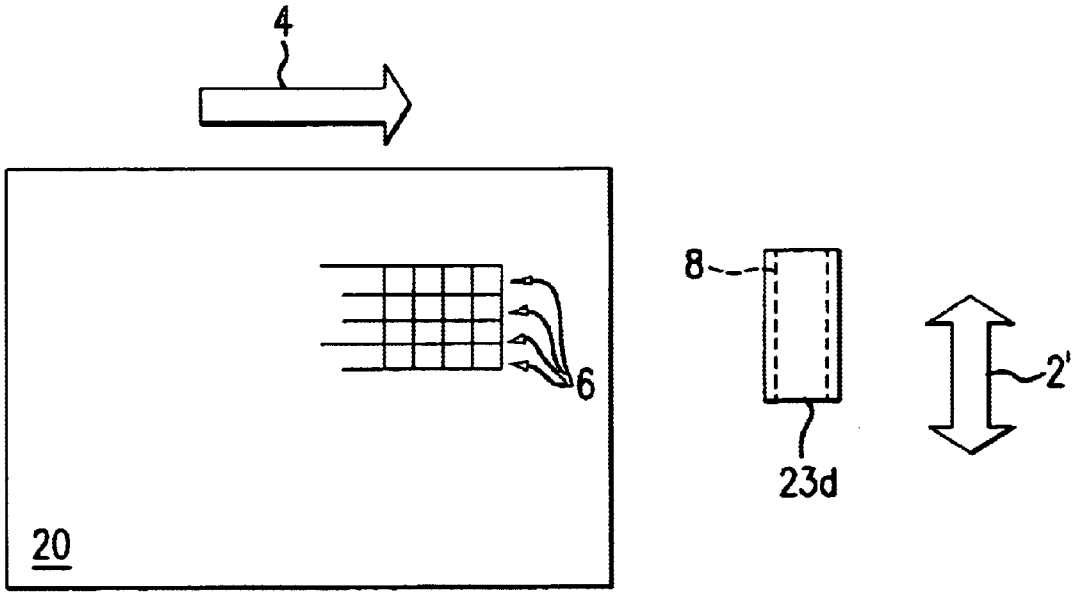

Referring now to the drawings, there is illustrated a preferred embodiment of an inkjet printing system and method constructed in accordance with the present invention which provides a means for printing using both pigmented and dye-based aqueous inks. The present invention advantageously brings the complementary image quality and durability advantages offered by a combination of pigmented and dye-based inkjet inks to the types of coated media used in commercial offset printing, such as magazine stock, without incurring the prior disadvantages of mixing these ink types on these types of media. As governed by a controller, drops of a pigmented ink of a certain color are deposited from a pigmented nozzle array, and drops of a dye-based ink of the same color are deposited from a dye-based nozzle array to form a printed region of that color. The controller places drops from the pigmented ink supply and drops from the dye-based ink supply on different subregions of the region.

As best understood with reference to FIG. 1, a preferred embodiment of the inkjet printing system 10 includes an inkjet printer 12 coupled to receive a print job from a print job source 14. The print job can be in a format compatible with the printer, such as a page description language (PDL) file or a page control language (PCL) file. The print job source 14 can be, for example, a computer, a personal digital assistant (PDA), a network server, or the like. The printer 12 can be connected directly to the print job source 14 or coupled to the print job source 14 via a network. Alternatively, the print job source 14 can be a dedicated device such as, for example, a camera or an electronic photograph processing machine.

The printer 12 includes a housing 16 that supports the various subcomponents of the printer 12 described below. The printer 12 includes an inkjet printhead assembly 18 used to print a desired pattern as dictated by the print job on a print medium 20 by depositing drops of ink corresponding to the pattern on the print medium 20. A plurality of ink supplies 24 provide the ink to the printhead assembly 18 via a fluidic coupling between the printhead assembly 18 and the ink supplies 24. For each color to be printed, the plurality of ink supplies 24 preferably includes a pigmented ink supply and a dye-based ink supply, each of which are of the same color. A platen 28, having a media supporting surface, is disposed under the print medium 20 opposite the printhead assembly 22. The print medium 20 is supplied from a roll of stock material 30 that forms a continuous web of printable material. The printable material is preferably coated media used in commercial offset printing, but can alternatively be other materials such as paper, photographic print media, or the like. In an alternate embodiment, the print medium 20 may be cut sheets that are sheet-fed, instead of being supplied from the roll.

Deposition of ink from the printhead assembly 18 onto the print medium 20 is controlled by a controller 32, as will be discussed subsequently in greater detail. The controller 32 also controls a drive assembly 34 for advancing the print medium 20 through the printer 12. In some embodiments a cutter assembly 36, also under the control of the controller 32, is provided to cut the web of material comprising the print medium 20 between printed pages or images such that individual printed sheets are produced by the printer 12. As one skilled in the art will appreciate, the printer 12 can be provided with additional subassemblies for assisting in printing on the print medium 20 and can include, for example, rollers, mechanical actuators, power supplies, a communications interface for communicating with the print job source 14, and the like.

Considering now in further detail the printhead assembly 18, and with reference to FIGS. 2A–D, a preferred printhead assembly 18 includes an in-line page-wide arrangement 23*a* or a staggered page-wide arrangement 23*b* of ink drop deposition nozzles, such as nozzle 8. Each page-wide arrangement 23*a*, 23*b* includes sufficient nozzles 8 to print on all rows 6 of the medium 20, and all columns 7 can be printed as the medium 20 advances in the media advance direction 4 under the page-wide arrangement 23*a*, 23*b*. The nozzles 8 may be physically arranged in one or more page-wide columns 40 as in in-line page-wide arrangement 23*a*, or may be physically arranged in staggered columns 40*a*–40*d* as in staggered page-wide arrangement 23*b*. If the columns are staggered, the controller 32 compensates for the staggering so as to ensure that the image pattern is properly printed on the medium 20 as the medium passes under the corresponding staggered portion of the arrangement 23*b*.

Alternatively, a printhead assembly 22 may include a reciprocating arrangement 23*c* of ink drop deposition nozzles 8. In a reciprocating arrangement 23*c*, one or more columns 40' of nozzles 8 are typically oriented orthogonal to the orientation of those in a page-wide arrangement 23*a*, 23*b*. In order to print on all rows 6 of the medium 20, the reciprocating arrangement 23*c* is reciprocated in a scan direction 2, under control of the controller 32. The movement of the reciprocating arrangement 23*c* in the scan direction 2 and the movement of the medium 20 in the media advance direction 4 are coordinated so as to print on all columns 7 of the medium 20 as well.

A yet further alternative printhead assembly 22 may include a less than page-wide arrangement 23*d* which includes sufficient nozzles 8 to print on only a desired portion of rows 6 of the print medium 20. The arrangement 23*d* is positionable along axis 2' for printing the desired rows 6 of the medium 20 as it passes under the arrangement 23*d*. Such an arrangement 23*d* may be advantageously used, for example, in applications where a standard preprinted medium 20 is customized by printing the desired portion. Such an example application may be imprinting a generic advertisement with the name and location of a participating vendor.

Figure 3:
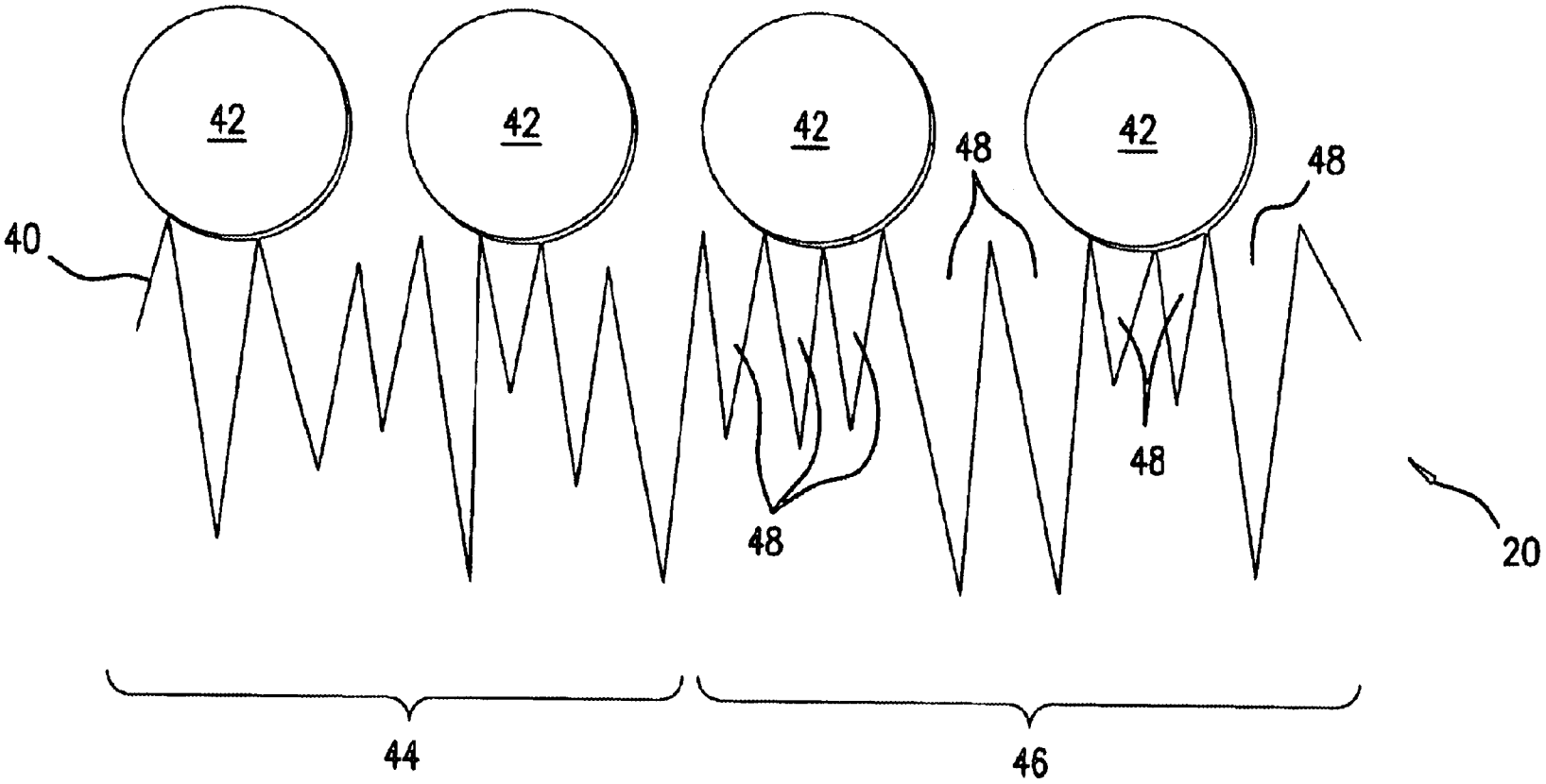
FIG. 3 is a magnified schematic cross-sectional view of an exemplary portion of ink deposition on a commercial offset printing medium produced by the system of FIG. 1.

Additional details of the arrangement of the nozzles 8, their interconnection to ink supplies, and their operation for depositing drops of ink on the medium 20 will be discussed subsequently in greater detail. But before discussing these aspects, it is useful to consider, with reference to FIG. 3, the print medium 20 and the deposition of ink thereon. While the surface of coated media 20 used in commercial offset printing appears and feels to be smooth, the surface 40 of the medium 20—as illustrated in this magnified schematic edge view of an exemplary portion of ink deposition on the medium 20—is actually rough and pitted when scaled to the size of the pigment particles 42. A first portion 44 of the surface 40 illustrates deposition of only pigment 42, when a second portion 46 of the surface 40 illustrates deposition of both pigment 42 and dye 48. The pigment particles 42 are typically approximately 0.1 micron in size, and since the grain of the surface is considerably smaller, the pigment particles 42 rest on the surface 40 of the medium 20. Conversely, the dye 48 is small enough to penetrate into the cracks and crevices in the surface 40. A binder resin in the ink preferably helps the pigment particles 42 to adhere to the surface 40 in the pigment-only portion 44. However, where dye 48 is applied, the surface 40 is chemically changed or "stained" such that the effectiveness of the binder resin in adhering the pigment particles to the surface 40 is disadvantageously degraded. Therefore, to provide the optimal image quality and durability, pigment 42 and dye 48 should not be deposited on the same locations of offset coated media 20.

Figure 4A:
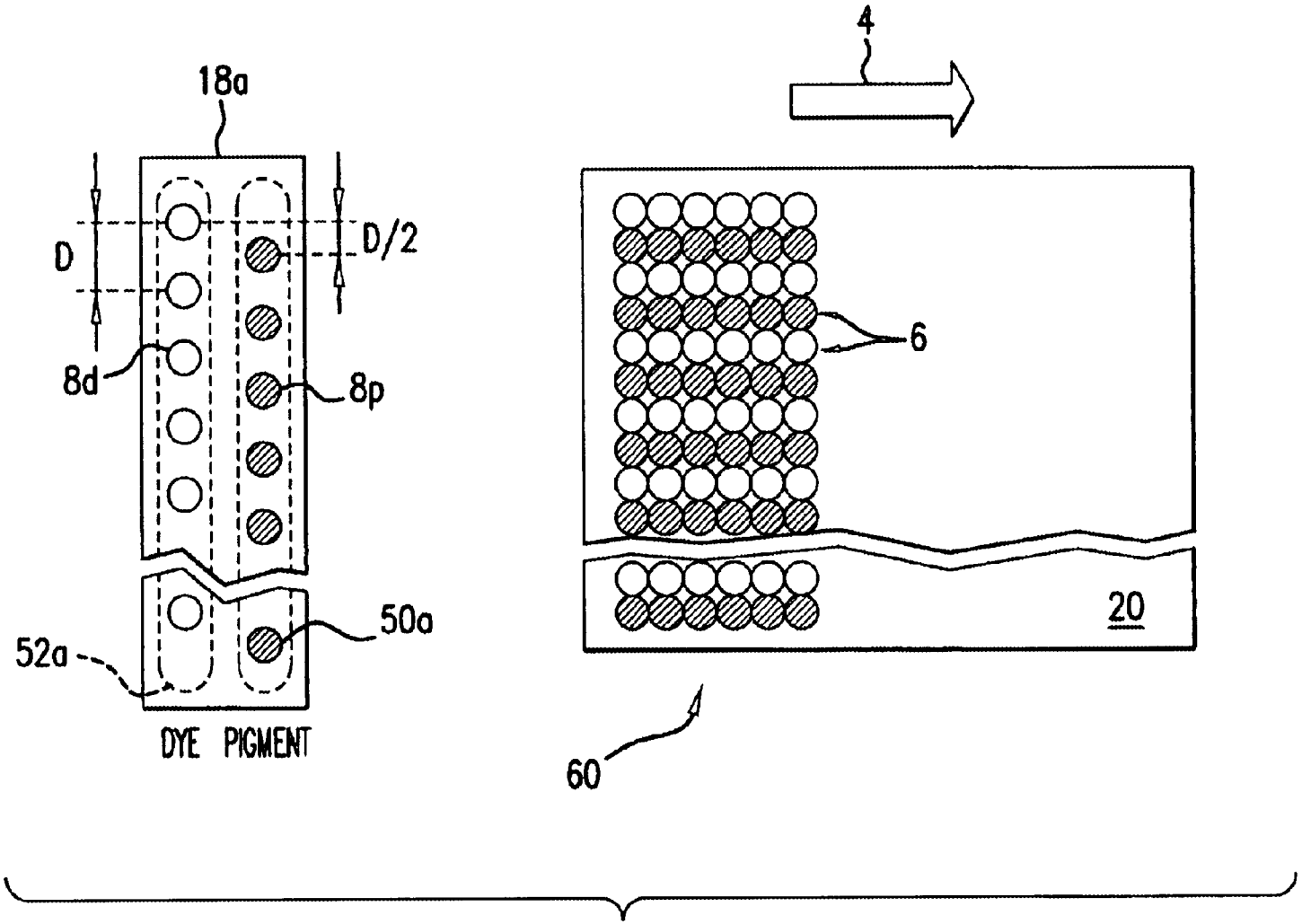
FIG. 4A is a schematic representation of one printhead assembly and its exemplary printed output illustrating the placement of pigmented and dye-based inks in a region of a certain color on the print medium.
Figure 4B:
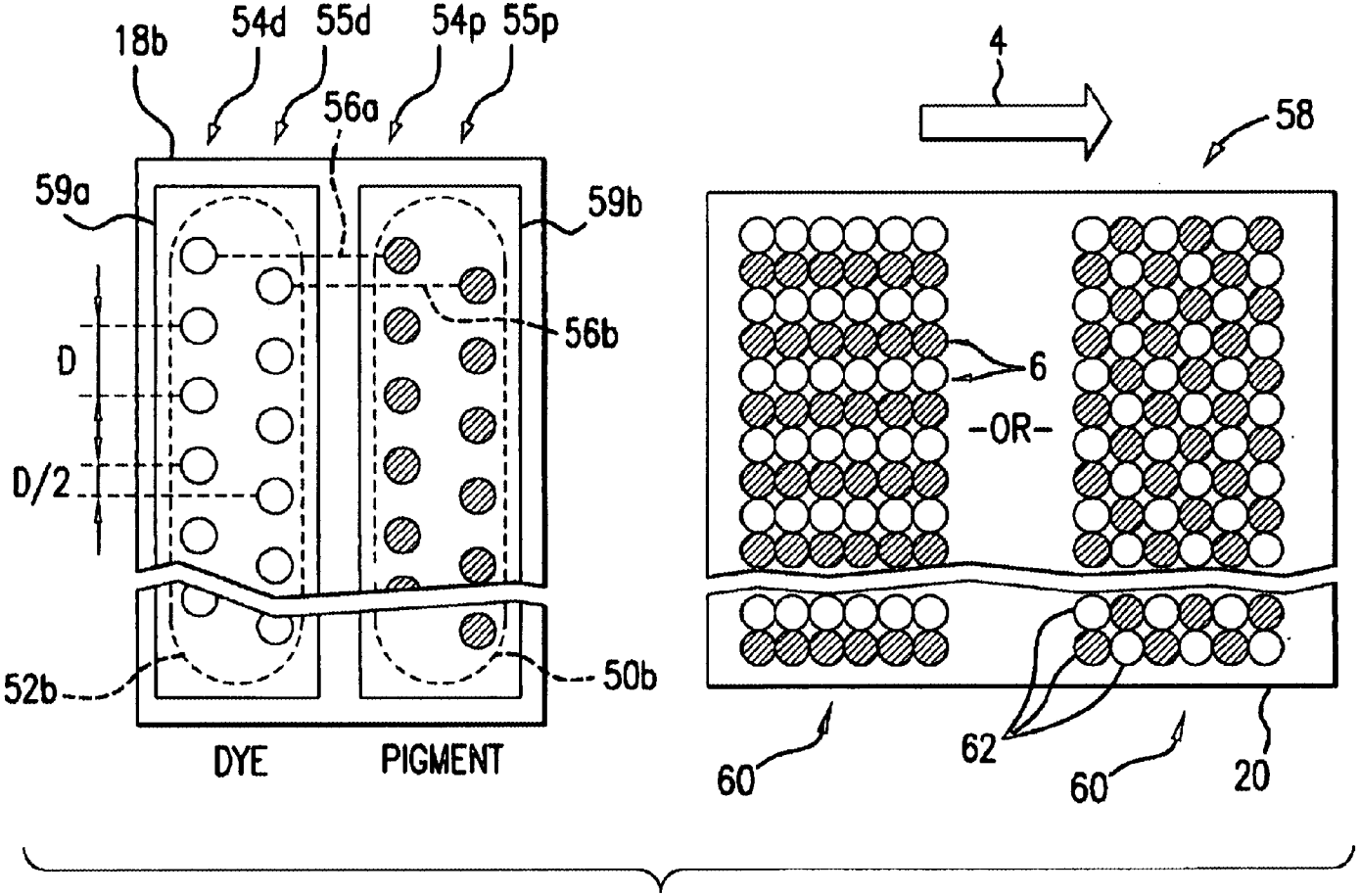
FIG. 4B is a schematic representation of another printhead assembly and its exemplary printed output illustrating alternative placements of pigmented and dye-based inks in a region of a certain color on the print medium.

Considering now in further detail the arrangement of ink drop deposition nozzles 8 on the printhead assembly 18 and their interconnection to ink supplies, and with reference to FIGS. 4A–4B, the printhead assembly 18*a*, 18*b* includes a pigmented nozzle array 50*a*, 50*b* for controllably depositing drops of a pigmented ink of a certain color from a pigmented ink supply 24 fluidically coupled to the pigmented nozzle array 50*a*, 50*b*, and a dye-based nozzle array 52*a*, 52*b* for controllably depositing drops of a dye-based ink of the same color from a dye-based ink supply 24 fluidically coupled to the dye-based nozzle array 52*a*, 52*b*.

In one preferred embodiment of the printhead assembly 18*a*, the pigmented nozzle array 50*a* includes a single column of pigmented drop deposition nozzles 8*p*, while the dye-based nozzle array 52*a* includes a single column of dye-based drop deposition nozzles 8*d* disposed substantially parallel with the column of pigmented nozzles 8*p*. At least some of the pigmented nozzles 8*p* are separated from each other by a spacing D, and at least some of the dye-based nozzles 8*d* are separated from each other by the spacing D. However, the pigmented drop deposition nozzles 8*p* are offset from the dye-based drop deposition nozzles 8*d* along the length of the columns by a fraction of the spacing D. Preferably the offset is such that the spacing between at least some pairs of pigmented nozzles 8*p* and dye-based nozzles 8*d* is equivalent to the distance D/2. Such an offset allows pigmented ink drops from the pigmented nozzles 8*p*, and dye-based ink drops from the dye-based nozzles 8*d*, to be deposited on different rows 6 of the print medium 20 as the medium 20 is moved in the media advance direction 4 orthogonal to the columns.

In another preferred embodiment of the printhead assembly 18*b*, the pigmented nozzle array 50*b* and the dye-based nozzle array 52*b* each include a first column 54*p*, 54*d* and a second column 55*p*, 55*d* of drop deposition nozzles 8, the nozzles 8 in each column separated by a spacing D, and each first column 54*p*, 54*d* substantially parallel with its corresponding second column 55*p*, 55*d*. The nozzles 8 in each first column 54*p*, 54*d* are offset from the nozzles 8 in the corresponding second column 55*p*, 55*d* of that nozzle array 50*a*, 50*b* along the length of the columns by a fraction of the spacing D, preferably the distance D/2. In addition, the nozzles 8 in the first column 54*p* of the pigmented nozzle array 50*b* are substantially aligned 56*a* along the length of the columns with the nozzles 8 in the first column 54*d* of the dye-based nozzle array 52*b*, and the nozzles 8 in the second column 55*p* of the pigmented nozzle array 50*b* are substantially aligned 56*b* along the length of the columns with the nozzles 8 in the second column 55*d* of the dye-based nozzle array 52*b*. Such a nozzle array configuration allows pigmented ink drops and dye-based ink drops to be deposited on different rows 6 of the print medium 20 as the medium 20 is moved in the media advance direction 4 orthogonal to the columns. Such a nozzle array configuration alternatively allows pigmented ink drops and dye-based ink drops to be deposited on rows 6 of the medium 20 in a checkerboard pattern 58 as the medium 20 is moved in the media advance direction 4 orthogonal to the columns. The illustrated checkerboard pattern 58, which provides for printing with 50% pigmented ink and 50% dye-based ink is merely exemplary, and other inking patterns known in the art, some of which deposit different percentages of pigmented ink and dye-based ink, are also contemplated by the present invention.

The printhead assembly 18 includes one or more printheads containing the nozzle arrays 50, 52 and associated electrofluidic and/or electromechanical elements known in the art for controllably ejecting ink drops in inkjet printing. The preferred printhead assembly 18*a* has the pigmented nozzle array 50*a* and the dye-based nozzle array 52*a* disposed in a single printhead. The preferred printhead assembly 18*b* has the pigmented nozzle array 50*b* disposed in printhead 59*b* and the dye-based nozzle array 52*b* disposed in printheads 59*a*.

Each nozzle 8 in the nozzle arrays 50, 52 is controlled by the controller 32 to eject one or more drops of ink at specified times to form the pattern being printed, as is known to those of ordinary skill in the art. The controller 32 is communicatively coupled to the pigmented nozzle array 50*a*, 50*b* and the dye-based nozzle array 52*a*, 52*b*, and provides the signals required to eject the drops for deposition on the medium 20. The controller 32 orchestrates the ink drop deposition so as to place drops from the pigmented ink supply and drops from the dye-based ink supply on different subregions of a region 60 of a medium 20 which is to be printed in the specified color. As heretofore described, a subregion may be a row 6 of ink drop locations 62, so that drops from the pigmented supply and drops from the dye-based supply get deposited on alternating rows 6 of the region 60. A subregion may alternatively be a group of one or more ink drop locations 62, so that drops from the pigmented supply and drops from the dye-based supply get deposited in a checkerboard-like pattern on alternating subregions of the region 60.

Figure 5:
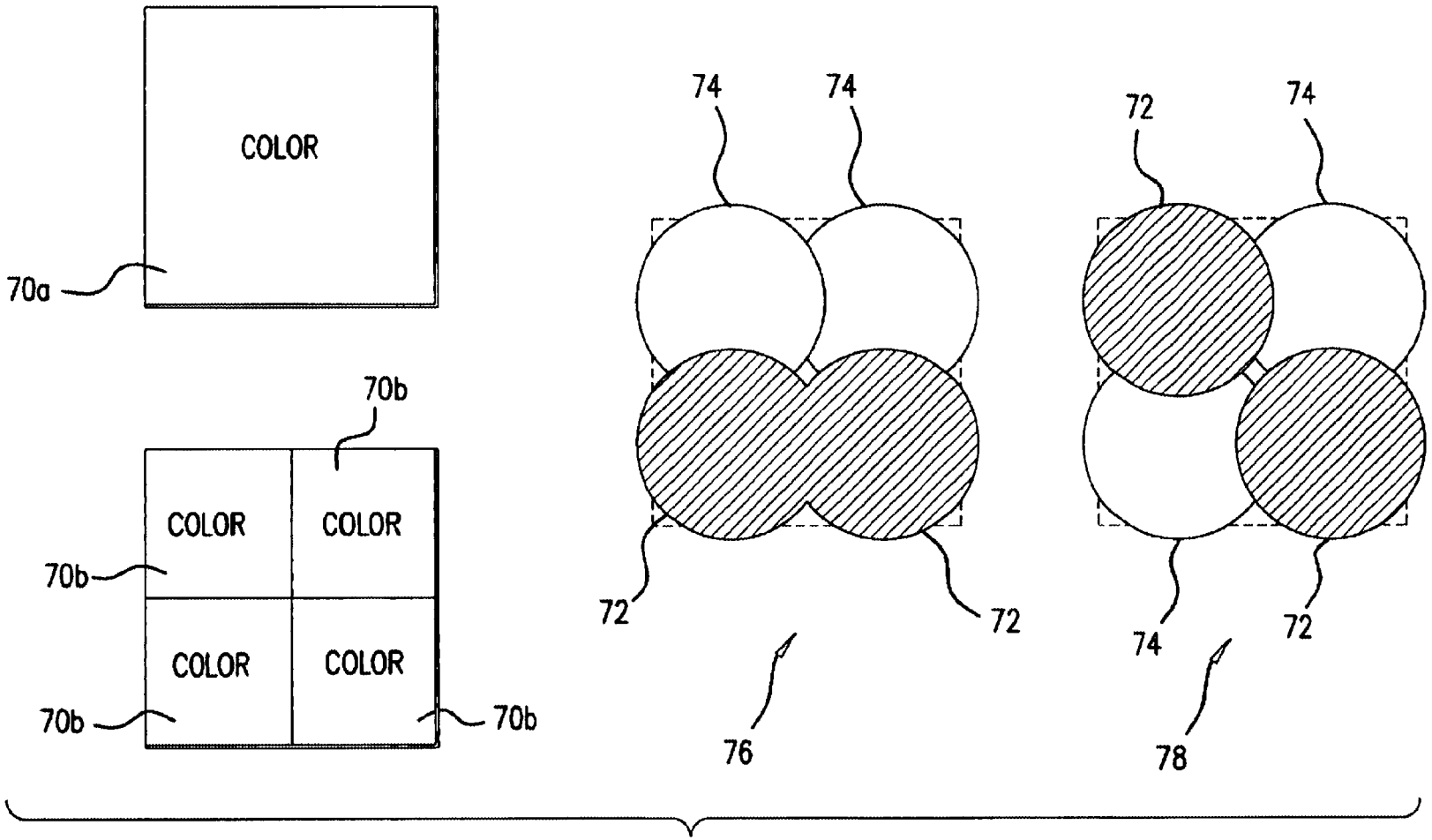
FIG. 5 is a schematic representation of the mapping of image data for a portion of a pattern to be printed to pigmented and dye-based ink drops.

Considering now in further detail the printing of a pattern by converting image data to ink drops, and with reference to FIGS. 4A, 4B, and 5, it is well known in the art that digital image data is typically represented in a raster format of rows and columns of rectangular (preferably square) image pixels. Each pixel generally includes a color and an intensity. The size of each pixel is related to the resolution of the image data, usually expressed in pixels or dots per inch (dpi). Commonly used resolutions for image data include 150 dpi, 300 dpi, 600 dpi, and 1200 dpi.

The printer 12 also has a maximum printing resolution, also typically expressed in dpi, which is generally determined by the nozzle spacings and the distance of advance in the media access direction. For example, if spacing D provides a 600 dpi resolution, the offset between nozzle columns which produces effective spacing D/2 in turn provides an effective 1200 dpi printing resolution.

During processing of the image data by the printing system 10 in preparation for printing, the color of at least some of the pixels may be modified as known in the art to map the image data to the ink colors in the printing system 10. If the modified pixel data maps to a color for which the printing system 10 has both pigmented ink and dye-based ink, then in some embodiments the relative resolutions of the modified pixel data and the printing system 10 determine which ink or inks are used to print the pixel. If a modified image pixel 70*a* is of a lower resolution (e.g. 300 dpi) than the printing system (600 dpi), then a plurality of ink drop locations 62 on the medium 20 correspond to the pixel 70*a*, and the pixel 70*a* may be printed by depositing drops 72 from the pigmented supply and drops 74 from the dye-based supply on different ones of the plurality of ink drop locations 62. The ink drop deposition pattern may be a row pattern 76 or a checkerboard pattern 78.

Conversely, if a modified image pixel 70*b* is of the same resolution (e.g. 600 dpi) as the printing system (600 dpi), then a single ink drop location 62 on the medium 20 corresponds to the pixel 70*b*, and each pixel 70*b* may be printed by depositing either an ink drop 72 from the pigmented supply or an ink drop 74 from the dye-based supply on the ink drop location 62. Whether pigmented or dye-based ink is selected for an individual ink drop location 62 preferably depends on the ink chosen for adjacent ink drop locations 62, so that either a row pattern 76 or a checkerboard pattern 78 of pigmented and dye-based ink results in the region.

While pixels are typically rectangular or square, ink drops are generally substantially round or elliptical. In order to minimize undesirable white space 77 in the printed pattern, the ink drops 72, 74 may overlap on the medium 20. Since the overlap of dye-based and pigmented inks is undesirable for the reasons explained heretofore, the amount of overlap is also minimized such that a substantially larger portion of each ink drop location 62 contains only dye-based ink or only pigmented ink.

Figure 6:
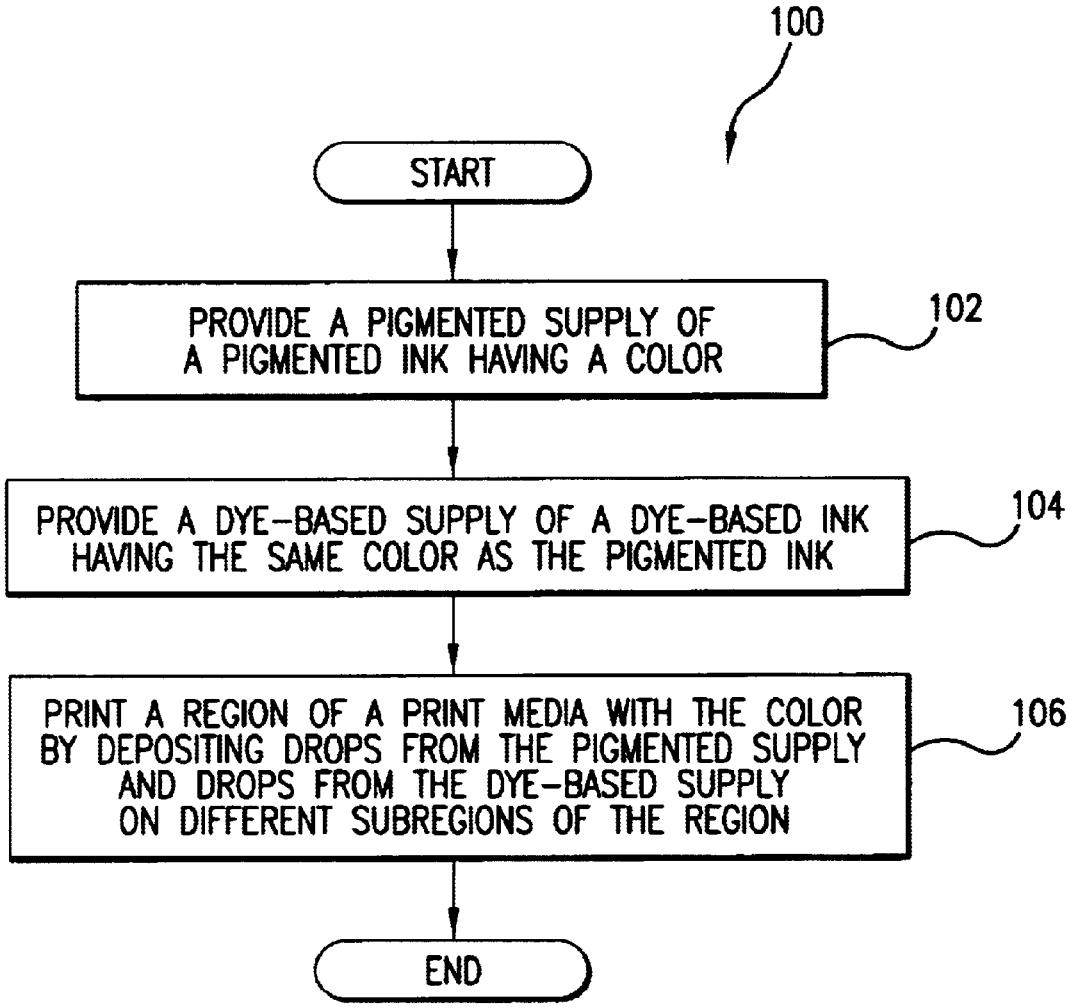
FIG. 6 is a flowchart of a printing method usable with the inkjet printing system of FIG. 1.

Another embodiment of the present invention, as best understood with reference to FIG. 6, is a method 100 of inkjet printing. The method 100 begins at 102 by providing a pigmented supply of a pigmented ink having a color. At 104, a dye-based supply of a dye-based ink having the color is also provided. At 106, a region 60 of a medium 20 is printed with the color by depositing drops from the pigmented supply and drops from the dye-based supply on different subregions of the region 60. Following 106, the method 100 concludes. In the preferred embodiment, controller 32 contains computer-executable steps to execute the flow of FIG. 6. These steps could be contained within a memory (not shown) in controller 32 and/or elsewhere in printer 12.

From the foregoing it will be appreciated that the inkjet printing system and methods provided by the present invention represent a significant advance in the art. Although several specific embodiments of the invention have been described and illustrated, the invention is not limited to the specific methods, forms, or arrangements of parts so described and illustrated. In particular, while the present invention has been described with reference to commercial printing applications where the print media is supplied on a roll, the invention is not limited to such printing applications, but can also be used in printing applications that use cut sheets of media, such as office or home printers. Additionally, while the advantages of the present invention have been described with reference to coated media for commercial offset printing, the printing system and methods may also offer advantages in printing on other types of media as well. Further, while page-wide printing has been described with regard to media moving past a fixed printing assembly, the present invention is also usable with printing systems where the media remains fixed while the page-wide printing assembly moves. The invention is limited only by the claims.

What is claimed is:

1. A method of inkjet printing, comprising:

providing a pigmented supply of a pigmented ink having a color;

providing a dye-based supply of a dye-based ink having the color; and printing a region of a medium with the color by depositing drops from the pigmented supply and drops from the dye-based supply on different subregions of the region.

2. The method of claim 1, wherein the color is black.

3. The method of claim 1, wherein the medium is a coated medium used for commercial offset printing.

4. The method of claim 1, wherein the printing improves optical density, durability, and lightfastness of the printed region.

5. The method of claim 1, wherein the subregions are substantially rectangular and are arranged in rows and columns on the medium.

6. The method of claim 5, wherein the printing includes depositing drops from the pigmented supply and drops from the dye-based supply on alternating rows of the region.

7. The method of claim 5, wherein the printing includes depositing drops from the pigmented supply and drops from the dye-based supply in a checkerboard pattern on alternating subregions of the region.

8. The method of claim 1, wherein a plurality of subregions correspond to a pixel of image data having the color, and wherein the printing further comprises:

printing the pixel with the color by depositing drops from the pigmented supply and drops from the dye-based supply on different ones of the plurality of subregions.

9. The method of claim 1, wherein a plurality of subregions correspond to a pixel of image data having the color, and wherein the printing further comprises:

printing some of the pixels with the color by depositing drops from the pigmented supply on some of the plurality of subregions; and printing others of the pixels with the color by depositing drops from the dye-based supply on others of the plurality of subregions.

10. The method of claim 1, wherein the different subregions are alternating subregions.

11. The method of claim 1, wherein the pigmented ink and the dye-based ink are aqueous inks.

12. The method of claim 1,wherein the color is other than black.

13. A method of printing on media with an inkjet printhead, comprising:

providing a pigmented ink having a color;

providing a dye-based ink having the color; and printing a region of the media with the color by depositing drops of the pigmented ink and drops of the dye-based ink on different subregions of the region.

14. An inkjet printing system, comprising:

a pigmented nozzle array for controllably depositing drops of a pigmented ink having a color from a pigmented ink supply fluidically coupled to the pigmented nozzle array;

a dye-based nozzle array for controllably depositing drops of a dye-based ink having the color from a dye-based ink supply fluidically coupled to the dye-based nozzle array; and a controller coupled to the pigmented nozzle array and the dye-based nozzle array, the controller controlling the depositing so as to place drops from the pigmented ink supply and drops from the dye-based ink supply on adjacent subregions of a region of a print medium having the color.

15. The printing system of claim 14, wherein the pigmented nozzle array includes a column of pigmented drop deposition nozzles, at least some of the pigmented nozzles separated by a spacing;

wherein the dye-based nozzle array includes a column of dye-based drop deposition nozzles substantially parallel with the pigmented column, at least some of the dye-based nozzles separated by the spacing; and wherein the pigmented drop deposition nozzles are offset from the dye-based drop deposition nozzles along the length of the columns by a fraction of the spacing.

16. The printing system of claim 15, wherein the offset is such that pigmented ink drops and dye-based ink drops are depositable on different rows of the medium as the medium is moved in a direction orthogonal to the columns.

17. The printing system of claim 14, wherein the pigmented nozzle array and the dye-based nozzle array each include a first column and a second column of drop deposition nozzles, the nozzles in each column separated by a spacing and the two columns substantially parallel with each other;

wherein the nozzles in the first column are offset from the nozzles in the second column along the length of the columns by a fraction of the spacing; and wherein the nozzles in each first column and the nozzles in each second column are substantially aligned along the length of the columns.

18. The printing system of claim 17, wherein the configuration of the nozzle arrays is such that pigmented ink drops and dye-based ink drops are depositable on rows of the medium in a checkerboard pattern as the medium is moved in a direction orthogonal to the columns.

19. The printed system of claim 14, wherein the pigmented nozzle array and the dye-based nozzle array are located in a single printhead.

20. The printed system of claim 14,wherein the pigmented nozzle array and the dye-based nozzle array are located in different printheads.

21. An inkjet printing system, comprising:

a pigmented nozzle array for controllably depositing drops of a pigmented ink having a color;

a dye-based nozzle array for controllably depositing drops of a dye-based ink having the color; and a controller coupled to the pigmented nozzle array and the dye-based nozzle array, the controller controlling the depositing so as to place drops from the pigmented ink and drops from the dye-based ink on alternating subregions of a region of a print medium having the color.

22. An inkjet printing system, comprising:

means for providing a pigmented ink having a color;

means for providing a dye-based ink having the color; and means for printing a region of a print medium with the color by depositing drops of the pigmented ink and drops of the dye-based ink on different subregions of the region.

* * * * *